US007624967B1

(12) United States Patent
Doebler et al.

(10) Patent No.: US 7,624,967 B1
(45) Date of Patent: Dec. 1, 2009

(54) OPPOSED-ROPE HOIST DRIVEN TELESCOPING MAST

(75) Inventors: Gary R. Doebler, Elk River, MN (US); Thomas E. Jung, Welch, MN (US); Albert J. Sturm, Jr., Stillwater, MN (US)

(73) Assignee: Par Systems, Inc., Shoreview, MN (US)

( * ) Notice: Subject to any disclaimer, the term of this patent is extended or adjusted under 35 U.S.C. 154(b) by 363 days.

(21) Appl. No.: 11/737,422

(22) Filed: Apr. 19, 2007

Related U.S. Application Data

(60) Provisional application No. 60/793,131, filed on Apr. 19, 2006.

(51) Int. Cl.
*B66D 1/50* (2006.01)

(52) U.S. Cl. ..... 254/272; 254/275; 254/278; 254/285; 52/121; 52/118; 212/348

(58) Field of Classification Search ..... 254/268, 254/270, 272–275, 278, 284, 285, 289, 337; 212/319, 333, 348; 52/121, 118, 111
See application file for complete search history.

(56) References Cited

U.S. PATENT DOCUMENTS

| | | | | | |
|---|---|---|---|---|---|
| 326,336 | A | * | 9/1885 | Sandberg et al | 212/264 |
| 1,428,887 | A | * | 9/1922 | Hescock | 74/25 |
| 1,518,881 | A | | 12/1924 | Walker et al. | |
| 1,711,356 | A | | 4/1929 | Lewis et al. | |
| 2,503,018 | A | | 4/1950 | Wittman | 242/47 |
| 2,600,574 | A | | 6/1952 | Rayburn | 271/2 |
| 2,892,535 | A | | 6/1959 | Cullen et al. | 203/305 |
| 3,157,376 | A | | 11/1964 | Merker et al. | 248/49 |
| 3,214,033 | A | | 10/1965 | Nilsson | 212/55 |
| 3,247,978 | A | | 4/1966 | Neumeier | 214/1 |
| 3,291,921 | A | | 12/1966 | Waninger | 191/12 |
| 3,481,490 | A | | 12/1969 | Eiler | 212/55 |
| 3,580,451 | A | | 5/1971 | Tengling | 226/173 |
| 3,690,534 | A | | 9/1972 | Biron | 226/172 |
| 3,708,937 | A | | 1/1973 | Sterner | 52/118 |
| 3,736,710 | A | | 6/1973 | Sterner | 52/115 |

(Continued)

FOREIGN PATENT DOCUMENTS

GB 2179022 A 2/1987

OTHER PUBLICATIONS

"Striving for Excellence in Remote Positioning, Materials handling and Robotic Production", PAR Systems Application Literature, 1998.

*Primary Examiner*—Emmanuel M Marcelo
(74) *Attorney, Agent, or Firm*—Steven M. Koehler; Westman, Champlin & Kelly, P.A.

(57) ABSTRACT

An opposed-rope driven telescoping mast assembly includes a stationary support and a longitudinal mast comprising a longitudinal section joined to move relative to the stationary support. A drive assembly drives the longitudinal mast and includes a frame and a rotatable drum assembly mounted to the frame. A first rope is joined to the drum assembly and to the longitudinal mast to pull the longitudinal section in a first direction, while a second rope is joined to the drum assembly and to the longitudinal mast to pull the longitudinal section in a second direction. A sensor is operably coupled to the drive assembly to sense overload tension in the first rope or the second rope.

21 Claims, 5 Drawing Sheets

U.S. PATENT DOCUMENTS 3,768,666 A * 10/1973 Pamer ..... 212/319
3,837,502 A 9/1974 Hornagold ..... 212/55
3,840,128 A 10/1974 Swobod, Jr. et al. ..... 214/1
3,985,234 A 10/1976 Jouffray ..... 212/144
4,004,695 A 1/1977 Hockensmith et al. ..... 212/144
4,016,688 A 4/1977 Tiffin et al. ..... 52/118
4,114,043 A 9/1978 Gansfried ..... 250/445
4,171,597 A 10/1979 Lester et al. ..... 52/118
4,258,825 A * 3/1981 Collins ..... 182/14
4,316,309 A 2/1982 Richter ..... 26/93
4,327,533 A 5/1982 Sterner ..... 52/115
4,364,545 A * 12/1982 Kobylinski ..... 254/284
4,387,481 A * 6/1983 Zalewski ..... 15/316.1
4,459,786 A 7/1984 Pitman et al. ..... 52/115
4,501,011 A * 2/1985 Hauck et al. ..... 378/196
4,534,006 A 8/1985 Minucciani et al. ..... 364/510
4,547,119 A 10/1985 Chance et al. ..... 414/735
4,600,817 A 7/1986 Hackenberg ..... 191/12
4,691,806 A 9/1987 Jansen et al. ..... 187/413
4,782,713 A 11/1988 Torii et al. ..... 74/89
4,789,120 A 12/1988 Spidel ..... 248/49
4,957,207 A 9/1990 Thomas ..... 212/192
5,078,364 A * 1/1992 Harrell ..... 254/387
5,117,859 A 6/1992 Carlson ..... 137/355
5,314,083 A 5/1994 Wiggershaus et al. ..... 212/213
5,326,010 A 7/1994 Moras ..... 226/172
5,401,134 A 3/1995 Habicht et al. ..... 187/413
5,465,854 A 11/1995 Sturm et al. ..... 212/319
5,478,192 A 12/1995 Bentivoglio ..... 414/918
5,557,892 A * 9/1996 Lavin ..... 52/121
6,026,970 A 2/2000 Sturm, Jr. et al. ..... 212/348
6,202,831 B1 3/2001 Manthei ..... 198/602
6,234,453 B1 * 5/2001 Block ..... 254/285
6,561,368 B1 * 5/2003 Sturm et al. ..... 212/319
6,571,970 B1 * 6/2003 Spoeler et al. ..... 212/333
6,942,198 B2 * 9/2005 Huang ..... 254/387
7,048,257 B2 * 5/2006 Wentworth et al. ..... 254/326
7,195,216 B2 * 3/2007 Wang ..... 248/157
2007/0089925 A1 * 4/2007 Addleman ..... 180/313

* cited by examiner

OPPOSED-ROPE HOIST DRIVEN TELESCOPING MAST

CROSS-REFERENCE TO RELATED APPLICATIONS

This application claims the benefit of U.S. Provisional Patent Application Ser. No. 60/793,131, filed Apr. 19, 2006, which is hereby incorporated by reference in its entirety.

BACKGROUND

The discussion below is merely provided for general background information and is not intended to be used as an aid in determining the scope of the claimed subject matter.

Telescoping assemblies such as disclosed in U.S. Pat. No. 5,465,854 are known. Generally, the telescoping tube assembly disclosed in this patent includes a first longitudinal tube section attached to a mounting platform and a second longitudinal section that telescopes relative to the first longitudinal tube section. Additional tube sections can be disposed within each other and within the second longitudinal tube section. Each longitudinal tube section includes a rigid support plate with a U-shaped housing having two spaced-apart longitudinal edges, which attach to the corresponding rigid support plate. Between each longitudinal section are linear bearings or wheels, which allow for the telescopic movement.

In one embodiment, the telescoping tube assembly operates vertically in that the longitudinal tube sections extend and retract downwardly from the first longitudinal tube section. The telescoping action is produced by a drum having a drive cable wrapped therearound and attached to the inner tube section. If the mast has more than one movable tube section, reeving cables or belts can be provided to control movement of each tube section. However, a disadvantage of the above-described assembly is that the use of drive cables limits operation to vertical deployment since the cables can not operate in compression, but only in tension.

In many applications, such as lifting or milling operations, it is necessary that the telescoping tube assembly be able to operate in the presence of compression and tension forces. Drive assemblies have been advanced for telescoping tubes or cranes that used elongated hydraulic cylinder units to extend and retract individual sections. However, as the telescopic assembly increases in size and weight and in the number of moveable sections, the size, weight, number and complexity of hydraulic cylinders increases accordingly. Similarly, other telescopic drive assemblies have used ball-screw assemblies to extend and retract each of the sections, but the size, weight, number and complexity of ball-screw assemblies also increases with the number of moveable sections.

There is thus an ongoing need to provide improved means to operate telescoping assemblies.

SUMMARY

This Summary and the Abstract herein are provided to introduce a selection of concepts in a simplified form that are further described below in the Detailed Description. This Summary and the Abstract are not intended to identify key features or essential features of the claimed subject matter, nor are they intended to be used as an aid in determining the scope of the claimed subject matter. The claimed subject matter is not limited to implementations that solve any or all disadvantages noted in the background.

An opposed-rope driven telescoping mast assembly includes a stationary support and a longitudinal mast comprising a longitudinal section joined to move relative to the stationary support. A drive assembly drives the longitudinal mast and includes a frame and a rotatable drum assembly mounted to the frame. A first rope is joined to the drum assembly and to the longitudinal mast to pull the longitudinal section in a first direction, while a second rope is joined to the drum assembly and to the longitudinal mast to pull the longitudinal section in a second direction. A sensor is operably coupled to the drive assembly to sense overload tension in the first rope or the second rope.

DETAILED DESCRIPTION

Figure 1:
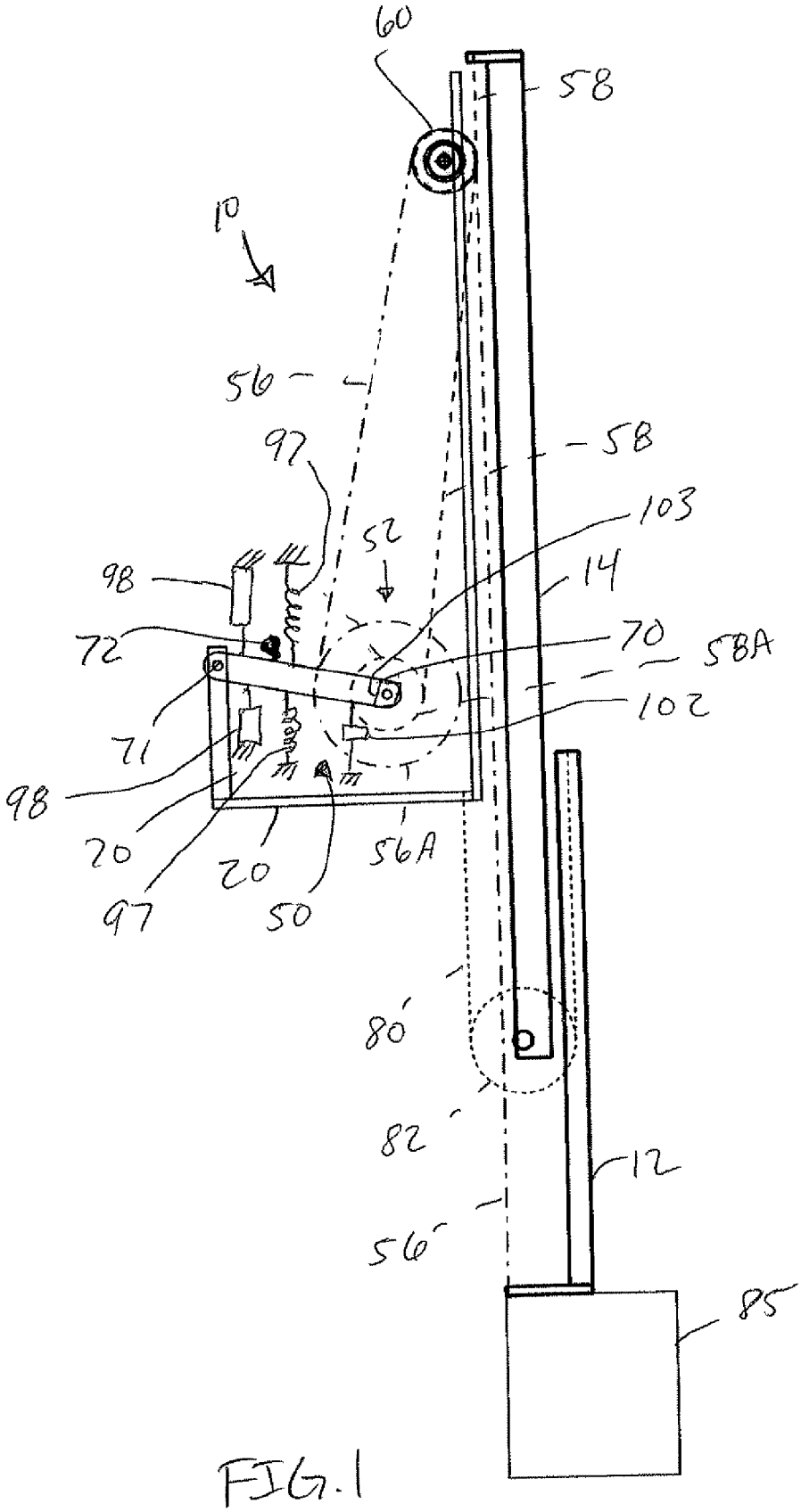
FIG. 1 is schematic diagram of a telescoping mast.

An embodiment of a telescoping mast assembly 10 is schematically illustrated in FIG. 1. In the exemplary embodiment, the telescoping mast assembly 10 is made up of two longitudinal sections 12, 14. The outer most longitudinal section 14 is movable such that it moves up and down relative to the fixed support 20. The section 12 is moveable such that it extends and retracts from within the section 14. Although illustrated and described herein with two sections, it should be understood the concepts herein described can be extended to three or more sections if desired.

A drive assembly 50 extends and retracts the sections 12, 14 relative to each other and the support 20. The sections 12 and 14 are extended and retracted in equal increments thereby exposing substantially the same length of each section during deployment. In other words, if section 12 is extended one foot relative to section 14, then section 14 is also extended one foot relative to support 20. In this manner, overall rigidity of the telescoping assembly 10 is maintained at maximum capability for any position of extension.

To accomplish equal, incremental extension and retraction of the sections, the drive assembly 50 includes a rope and pulley system, which ties the sections 12, 14 together so that moving one section causes proportional movement in the other. Herein "rope" is intended to describe any elongated element that operates or is used in tension. Another form of such an element could be a chain.

In the embodiment illustrated, the wire rope and pulley assembly includes a drum assembly 52 capable of extending and retracting two wire ropes. For example, the drum assembly 52 includes grooved drums 56A, 58A that are joined together so that they turn together. Each drum 56A, 58A controls a wire rope. In particular, the wire ropes comprise a retracting rope 56 and an extending rope 58. The wire ropes 56, 58 are wound in opposite directions on their corresponding drums 56A, 58A. The retracting rope 56 is attached to the bottom of the section 12 and pulls up as the telescoping mast retracts. The retracting rope 56 is guided onto the drum assembly 52 via a pulley 60 provided on the support 20. The retracting rope 56 provides a force for retracting the sections 12, 14.

The extending rope 58 is attached to the top of the section 14 and pulls down on the section 14 as the telescoping mast extends, thereby allowing the mast to apply a downforce to the sections 12, 14 if needed. (A pulley (not shown) but located adjacent to pulley 60 can be used to guide rope 58 to the top of section 14.) Since the section 12 travels twice the distance of the section 14, the drum 56A that drives/controls the section 12 is twice the diameter of the drum 58A that drives/controls the section 14.

A timing rope 80 is attached to the upper end of section 12 and the support 20, but wraps around a pulley 82 provided on the lower end of section 14. The timing rope 80 ensures equal proportional movement of the sections 12, 14 even though section 12 travels twice as fast as section 14 relative to support 20.

As another aspect, the arrangement of the ropes 56, 58 and timing rope 80 is also helpful in that in operation the ropes are in tension; thus, preloading the sections 12 and 14 relative to each other to bring them together. This preload reduces, if not substantially eliminates any meaningful backlash such that the movement of the mast 10 is predictable and accurate.

Figure 2:
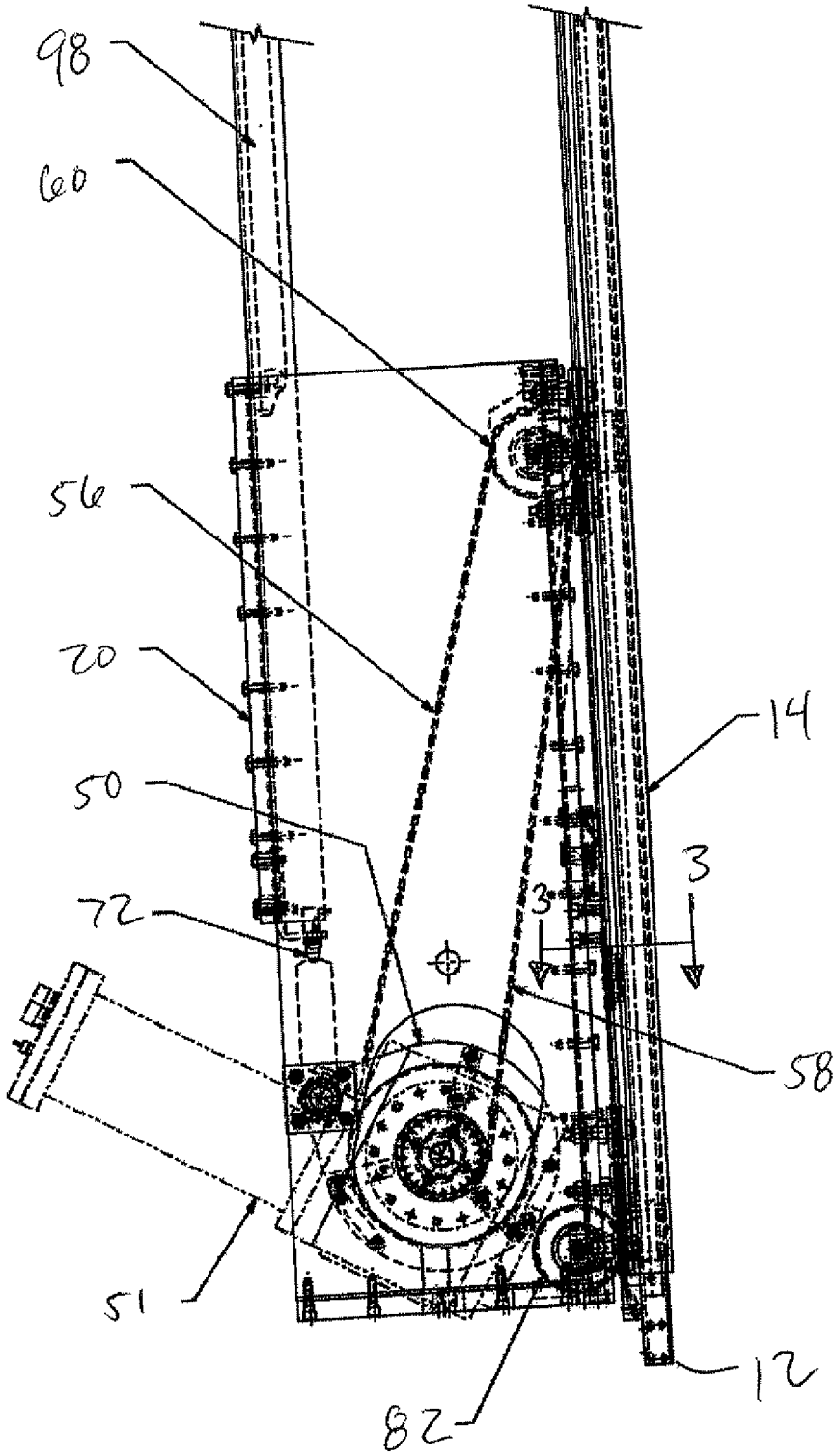
FIG. 2 is a side elevation view of a telescoping mast.

The drum assemblies and drive motor (not shown in FIG. 1) are mounted to a frame 70 that moves relative to the support 20. In the embodiment illustrated, the frame pivots on pivot 71; however, pivoting movement should not be considered limiting in that other movements such as linear movement could also be used. Nevertheless, a pivoting frame will be described as an exemplary embodiment. In this embodiment, the weight of the drive assembly 50 (e.g. drive motor/gear reducer 51 (FIG. 2), drums 56A, 58A and frame 70) acts as a counterbalance to offset at least some of the weight of the moving sections 12, 14 and any tool provided on the end of section 12. Accordingly, the weight of the counterbalance can be adjusted if necessary depending on the weight of the sections 12, 14 and the end effector or payload 85 on the end of the section 12.

Mounting components of the drive assembly 50 on the pivoting frame 70 is advantageous. In particular, if the tension in one of the ropes 56, 58 increases due to the telescoping mast encountering an obstruction or an end of travel stop, this causes the drive assembly 50 to move (herein by example, pivot) and trip a suitable switch 72 that can be used to initiate stopping motion of the telescoping mast. Since the ropes 56, 58 pull in opposite directions, this form of overload protection works for both up and down motions of the telescoping mast. In other words, the winding of the ropes 56, 58 in opposite directions causes movement of the drive assembly 50 in one direction only, if an obstruction or end of travel stop is encountered.

In the embodiment illustrated, the extension and retraction overload set points are a function of the distance between the radial distance of the ropes 46, 48 reeling on or off their respective drum and a pivot point 71 of the frame 70. Therefore, in the embodiment illustrated, the overload set points are different. Thus, depending on the configuration of the drums relative to the pivot point 71, the set points can be adjusted individually. Other factors that can be used to adjust the overload set points include the location of the pivot point 71, the weight on frame 70, the length of the frame 70 from the pivot point 71. If desired, additional springs 97 and/or actuator devices 98 (electric, pneumatic, hydraulic) joined to the drive assembly 50 (and to the support 20 schematically) can be used to adjust the overload set points. For instance, the actuator device(s) 98 can be actively controlled by a controller (not shown) such that for extension of the mast 10, the actuator device(s) 98 have a first operating point so as to provide a first overload set point, while for retraction of the mast 10 the actuator device(s) 98 have a second operating point so as to provide a second overload set point. If actuator devices(s) 98 are present movement of components of the actuator devices(s) 98 or other operating parameters such as pressure or electrical voltage and/or current applied can be monitored to sense overload conditions.

Although illustrated with an overload trip switch, other forms of sensing devices, such as but not limited to mechanical, electrical, and/or optical sensing devices, can be used to detect movement of the frame 70, drive assembly 50 or portions thereof. For instance, an angle sensor can be used to measure the angular position of the frame 70 relative to the support 20. In another embodiment, a load cell can be used as an overload switch. One location is as illustrated with load cell 102; however other suitable can be configurations can be used. For instance, a load cell 103 can be used to join the drums 56A, 58A to frame 70, which is represented by load cell 103. In addition, load cells can also be configured in other positions to measure tension in ropes 56, 56 as is known in the art.

Movement of the drive assembly 50, or components thereof also causes both ropes 56, 58 and a timing rope 80 to reach a state of equilibrium when hung vertically. Although the tension in the ropes is not equal, the relationships between the tension in each rope generally remains constant.

Figure 3:
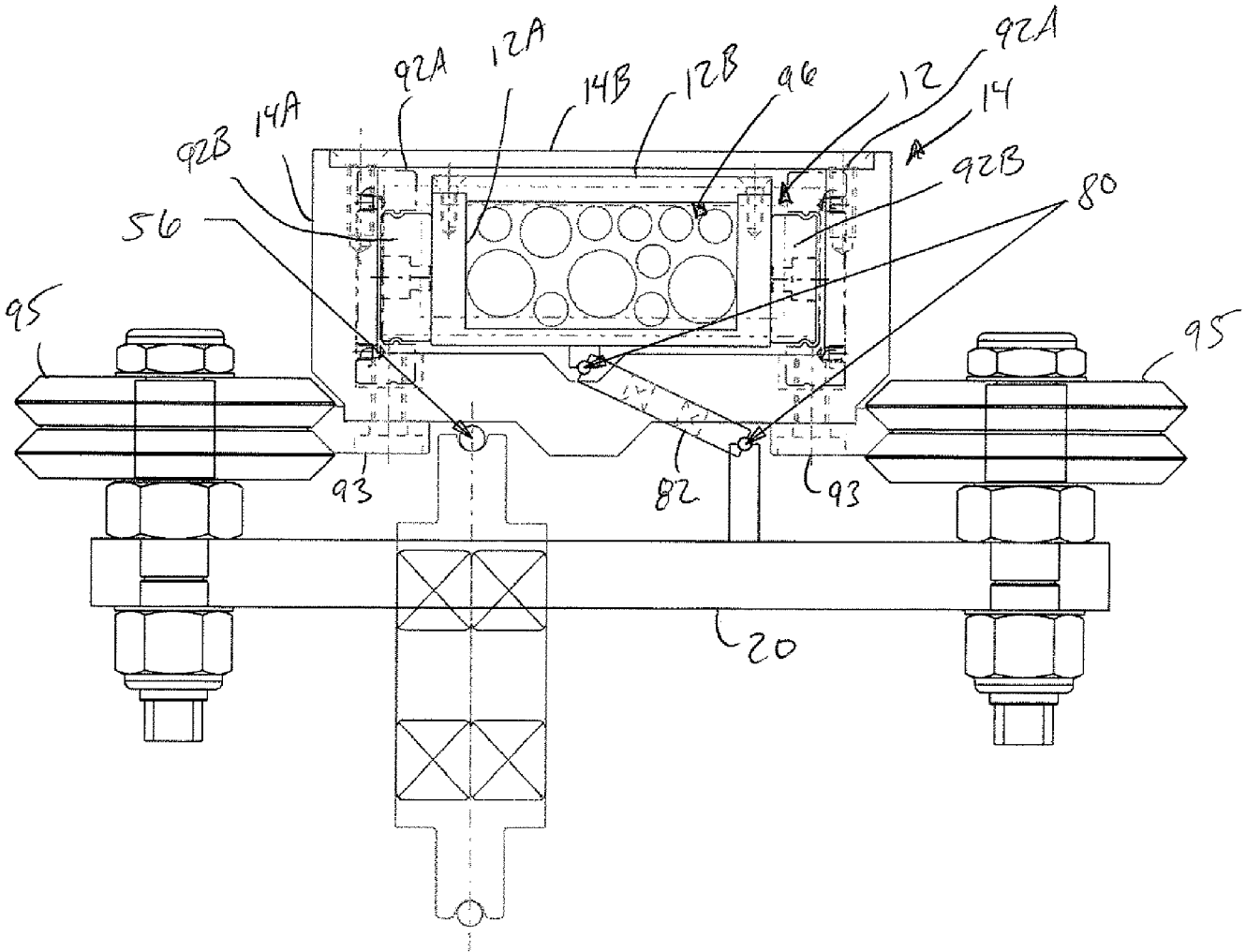
FIG. 3 is a section view of the mast taken at lines 3-3 in FIG. 2 with components removed.

FIG. 3 illustrates a cross-sectional view of the exemplary telescoping mast assembly 10, and in particular cross-sections of sections 12, 14, comprising tubes. Section 12 nests within section 14 and includes housing 12A and cover 12B mounted to housing 12A with fasteners 90. Section 14 is similarly constructed with housing 14A, cover 14B and fasteners 90. Section 12 carries a cable carrier 96 for positioning cables for an end effecter 85 provided at the remote end of section 12. Cables from the end effecter extend from the remote end of section 12 through sections 12 and 14, terminating back at support 20 through a flexible cable track 98.

In the embodiment illustrated, at least one linear bearing is operatively disposed between sections 12 and 14 and functions as a guiding assembly. Specifically, first linear bearing elements 92A are mounted to an inner surface of housing 14A, while second linear bearing elements 92B that cooperate with the first linear bearing elements 92A are mounted to the housing 12A. Similarly, at least one guiding assembly can be used between section 14 and support 20. In FIG. 3, the guiding assembly includes rails 93 mounted to section 14 and wheels 95 mounted to support 20. Although described herein using linear bearings between sections 12 and 14 and support 20, it should be understood that this is but one exemplary mechanism for guiding sections 12 and 14 relative to each other and support 20. In particular, numerous other mechanisms using for example, rollers, sprockets, etc. can be used.

Furthermore, the telescoping mast assembly 10 can have any number of sections where suitable wire ropes and timing ropes are provided as needed. In addition, the mast assembly 10 need not be telescoping tubes, but rather, the telescoping sections can take any number of forms. For instance, the telescoping sections can be of similar shaped cross-sections of different size, or not be similar such as where one or more sections are tubular and one or more are not tubular. The telescoping sections can be planar, for example, plate members, but again this is but one other embodiment and should not be considered limiting.

Figure 4:
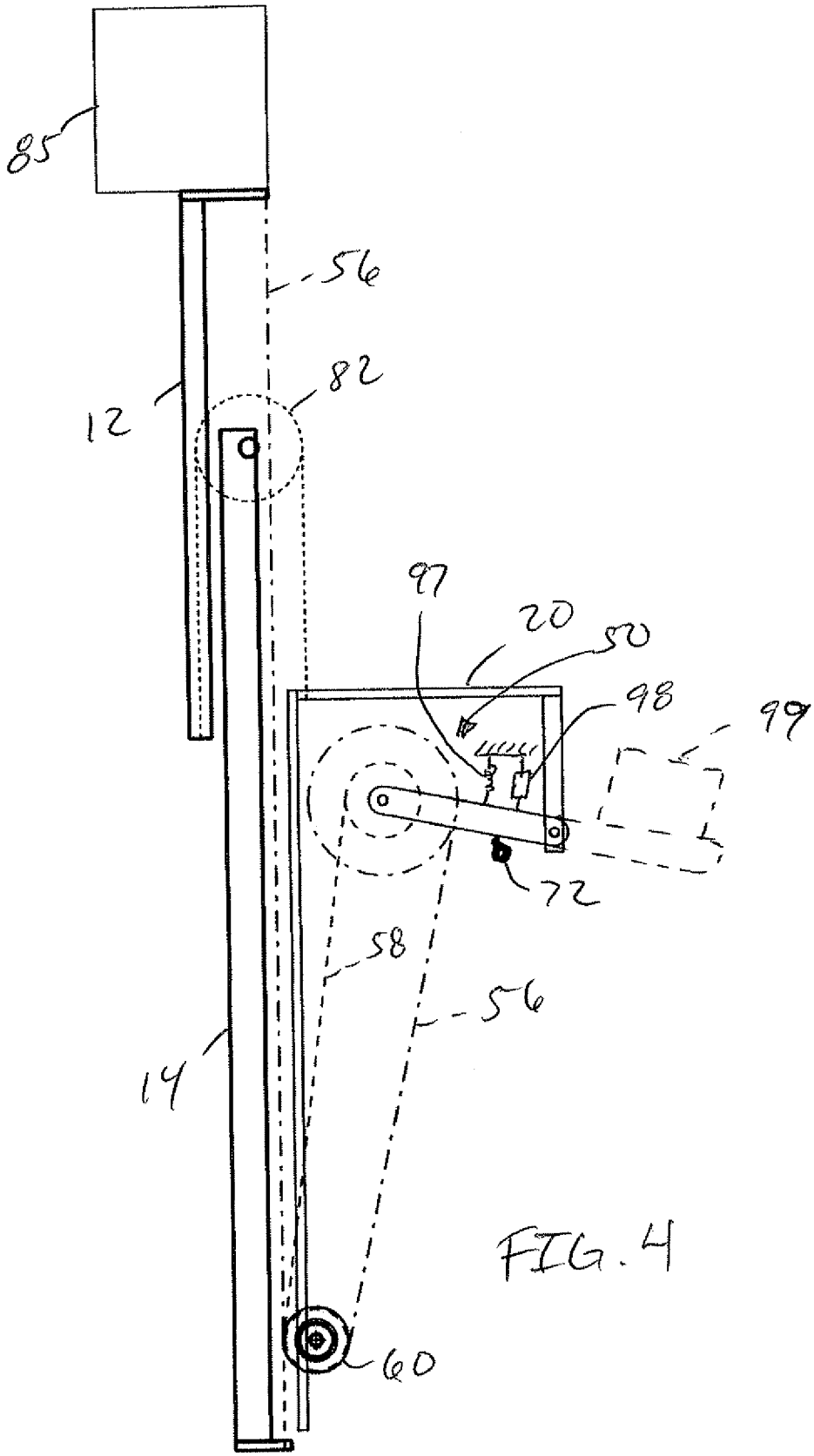
FIG. 4 is schematic diagram of a telescoping mast, illustrating a second operating position.

FIG. 4 illustrates another operating position of the mast wherein the mast 10 can extend in a telescoping manner upwardly. Due to the preload in the assembly tending to contract the sections toward each other from the tension in the ropes 56, 58, the remote end of section 14 can be accurately lifted upwardly. Like the embodiment described above, motion of drive assembly 50, or components thereof, can be used to sense overload conditions and/or load cells can be used. Springs 97 and/or actuator devices 98 as described above can be used to support the weight of the mast assembly 10, pivoting frame 70 and drive assembly 50. In another embodiment, the frame 70 can be extended beyond pivot point 71 as illustrated with dashed lines whereupon components of drive assembly 50 and/or additional mass 99 can be used to provide a counterbalance. Besides the downward extension of FIG. 1 and upward extension of FIG. 4, the mast 10 can be any configured to operate in any other desired angle of extension, or be moveable to any angle of extension.

Figure 5:
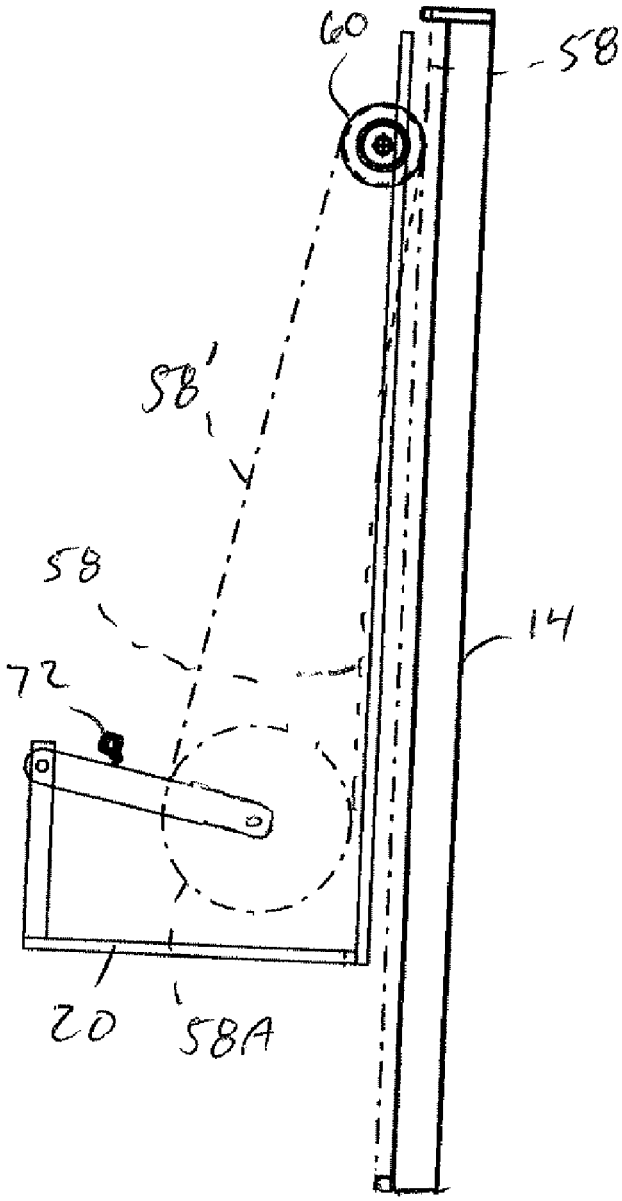
FIG. 5 is schematic diagram of a second telescoping mast.

Aspects described above can also be applied to a single moving section mast, which is illustrated in FIG. 5. Using the same reference numbers to identify similar elements, telescoping mast includes a single telescoping section 12. However, in this embodiment, drum 58A includes two ropes 58 and 58' (for example wound on drum side by side) that are both attached to section 14. Rope 58 is attached to one end, herein the top of section 14, while rope 58' is attached to the other end, herein the bottom and through pulley 60. When the section 14 is displaced relative to support 20, one rope pays out, while the other is retrieved. As in the previous embodiment, drive assembly 50, or components thereof, can move (herein exemplified as pivoting) in the same direction if an overload condition occurs. Sensing the overload condition can be done using any of the techniques described above. Springs and/or actuator devices can also be used as described above to support some of the weight of the section 14 and/or adjust the overload set point.

Although the subject matter has been described in language specific to structural features and/or methodological acts, it is to be understood that the subject matter defined in the appended claims is not limited to the specific features or acts described above as has been held by the courts. Rather, the specific features and acts described above are disclosed as example forms of implementing the claims.

What is claimed is:

1. An opposed-rope driven telescoping mast assembly comprising:

a stationary support;

a longitudinal mast comprising a longitudinal section joined to move relative to the stationary support;

a drive assembly having a weight that counterbalances at least a portion of the weight of the longitudinal section, the drive assembly comprising:

a frame pivotally joined to the stationary support;

a rotatable drum assembly mounted to the frame; and a first rope and a second rope, the first rope being joined to the drum assembly and to the longitudinal mast to pull the longitudinal section in a first direction, the second rope joined to the drum assembly and to the longitudinal mast to pull the longitudinal section in a second direction;

a sensor operably coupled to the drive assembly to sense overload tension in the first rope or the second rope by movement of the drive assembly; and a spring joined to the drive assembly to support at least a portion of the weight of the longitudinal section.

2. The telescoping mast assembly of claim 1 and further comprising a second longitudinal section moveably joined to the first-mentioned longitudinal section, and wherein the first rope is attached to the first-mentioned section and the second rope is attached to the second longitudinal section.

3. The telescoping mast assembly of claim 2 and further comprising a third rope joined to the support and the second longitudinal section.

4. The telescoping mast assembly of claim 2 and further comprising a pulley joined to the first-mentioned longitudinal section, the pulley guiding the third rope.

5. An opposed-rope driven telescoping mast assembly comprising:

a stationary support;

a longitudinal mast comprising a longitudinal section joined to move relative to the stationary support;

a drive assembly having a weight that counterbalances at least a portion of the weight of the longitudinal section, the drive assembly comprising:

a frame pivotally joined to the stationary support;

a rotatable drum assembly mounted to the frame; and a first rope and a second rope, the first rope being joined to the drum assembly and to the longitudinal mast to pull the longitudinal section in a first direction, the second rope joined to the drum assembly and to the longitudinal mast to pull the longitudinal section in a second direction;

a sensor operably coupled to the drive assembly to sense overload tension in the first rope or the second rope by movement of the drive assembly; and an actuator device joined to the drive assembly to support at least a portion of the weight of the longitudinal section.

6. The telescoping mast assembly of claim 5 and further comprising a second longitudinal section moveably joined to the first-mentioned longitudinal section, and wherein the first rope is attached to the first-mentioned section and the second rope is attached to the second longitudinal section.

7. The telescoping mast assembly of claim 6 and further comprising a third rope joined to the support and the second longitudinal section.

8. The telescoping mast assembly of claim 6 and further comprising a pulley joined to the first-mentioned longitudinal section, the pulley guiding the third rope.

9. An opposed-rope driven telescoping mast assembly comprising:

a stationary support;

a first longitudinal section joined to move relative to the stationary support;

a second longitudinal section joined to move relative to the first longitudinal section;

a drive assembly comprising:

a drum assembly having a first drum and a second drum;

a first rope and a second rope, the first rope being joined to the first drum for winding thereon and to the first longitudinal section, the second rope joined to the second drum for winding thereon in a direction opposite to the first rope and to the second longitudinal section;

a pulley mounted to the first longitudinal section; and a third rope joined to the second longitudinal section and the stationary support, the third rope being guided on the pulley.

10. The telescoping mast assembly of claim 9 wherein the first drum and second drum are configured to wind and unwind the second rope at a rate twice as fast as the first rope.

11. The telescoping mast assembly of claim 9 wherein the drive assembly includes a second pulley configured to guide the second rope, the second pulley being mounted to the stationary support.

12. The telescoping mast assembly of claim 9 wherein the drive assembly further comprises a frame member configured to move relative to the stationary support and carry the first drum and the second drum.

13. The telescoping mast assembly of claim 12 wherein the frame member pivots.

14. The telescoping mast assembly of claim 12 wherein the drive assembly is configured to substantially counter-balance the weight of the first and second longitudinal sections.

15. The telescoping mast assembly of claim 12 and a sensor configured to sense movement of the frame member.

16. The telescoping mast assembly of claim 15 wherein the frame member pivots.

17. An opposed-rope driven telescoping mast assembly comprising:

a stationary support;

a first longitudinal section joined to move relative to the stationary support;

a second longitudinal section joined to move relative to the first longitudinal section; and a drive assembly comprising:

a drum assembly having a first drum and a second drum; and a first rope and a second rope, the first rope being joined to the first drum for winding thereon and to the first longitudinal section, the second rope joined to the second drum for winding thereon in a direction opposite to the first rope and to the second longitudinal section, wherein the drive assembly is configured to maintain tension on the first rope and the second during extension and retraction of the sections limiting backlash movement of the sections relative to each other.

18. The telescoping mast assembly of claim 17 wherein the drive assembly further comprises a frame member configured to move relative to the stationary support and carry the first drum and the second drum.

19. The telescoping mast assembly of claim 18 wherein the frame member pivots.

20. The telescoping mast assembly of claim 19 wherein the drive assembly is configured to substantially counter-balance the weight of the first and second longitudinal sections.

21. The telescoping mast assembly of claim 20 and a sensor configured to sense movement of the frame member.

* * * * *